175-48 SR

10/7/86 XR 4,615,399

United States Patent [19]

Schoeffler

[11] Patent Number: 4,615,399

[45] Date of Patent: Oct. 7, 1986

[54] VALVED JET DEVICE FOR WELL DRILLS

[75] Inventor: William N. Schoeffler, Lafayette, La.

[73] Assignee: Pioneer Fishing and Rental Tools, Inc., Youngsville, La.

[21] Appl. No.: 799,611

[22] Filed: Nov. 19, 1985

[51] Int. Cl.[4] ..... E21B 21/10; E21B 21/12

[52] U.S. Cl. ..... 175/38; 175/48; 175/215; 175/317; 166/325

[58] Field of Search ..... 175/24, 25, 38, 48, 175/215, 243, 232, 234, 317, 318, 320; 166/318, 330, 157, 158, 320, 321, 325; 137/119

[56] References Cited

U.S. PATENT DOCUMENTS

| | | | |
|---|---|---|---|
| 2,375,313 | 5/1945 | Miller | 175/243 |
| 3,051,246 | 8/1962 | Clark, Jr. et al. | 166/325 X |
| 3,907,046 | 9/1975 | Gaylord | 175/317 X |
| 3,967,680 | 7/1976 | Jeter | 175/48 X |
| 4,072,166 | 2/1978 | Tiraspolsky et al. | 175/318 X |
| 4,470,464 | 9/1984 | Baldenko et al. | 166/325 |

*Primary Examiner*—Stephen J. Novosad
*Assistant Examiner*—David J. Bagnell
*Attorney, Agent, or Firm*—John D. Jeter

[57] ABSTRACT

A column of drill collars have holes or jets extending radially from the collar bore through the collar wall. A wash pipe extends full length through the bore of the perforated collars, so sized as to leave an annular flow space between the wash pipe and the collar bore wall. A remote control selector valve is situated such as to receive drilling fluid from the upwardly continuing drill string and direct the fluid through the wash pipe to the drill bit for regular drilling, or on cue from the earth surface, direct fluid to the annulus to be expelled through the drill collar perforations to help free stuck pipe or to prevent such sticking.

19 Claims, 7 Drawing Figures

VALVED JET DEVICE FOR WELL DRILLS

FIELD OF UTILIZATION

Apparatus of this invention will be used in drilling earth boreholes with pipe strings through which drilling fluid is circulated. The purpose is primarily to avoid sticking of the drill string or to aid in freeing drill strings once struck in the well bore.

REFERENCES TO RELATED ART

The following patents pertain to the art related to the invention:

U.S. Pat. No. 3,804,186, Apr., 1974,
U.S. Pat. No. 3,581,820, June, 1971,
U.S. Pat. No. 3,369,619, Feb., 1968,
U.S. Pat. No. 3,025,919, Mar., 1962,
U.S. Pat. No. 2,270,952, Jan., 1942.

BACKGROUND

Drill strings are prone to become stuck in the earth boreholes as drilling progresses. The mode of sticking addressed by this invention usually involves the drill collars used for ballast above a drill bit. Three mechanisms for sticking will be defined as typical. First, certain formations swell when exposed to some drilling fluids. The hole simply closes in on the drill string. Second, some formations behave as filters and draw liquid out of drilling fluid to continually add solids as coating to the bore hole wall. The hole effectively shrinks in this process. Third, there is usually a pressure difference between liquid in the bore and fluids in the formation. This in effect applies a suction to the drill collar surfaces in contact with the borehole wall. This is called "differential sticking."

To reduce the tendency for differential sticking, spiral grooves have been milled in drill collars. This helped pressure equalize around the drill collar periphery and was quite beneficial in many cases.

The U.S. Pat. No. 3,804,186 taught the use of holes (or jets) through the drill collar wall to permit fluid to be ejected radially against the bore wall to reduce the tendency for the collars to stick. The fluid could be applied to the collar wall jets by rotating the drill string backward to actuate a selector valve to close off the usual drilling fluid route through a drill bit and divert the fluid to the collar wall jets.

There is considerable reluctance in the oil drilling industry to rotate a drill string backward, because of the tendency of the drill string to disconnect at unpredictable locations. Additionally, the valve mechanism is effectively a free motion element, and some drilling situations are so severe as to develop weakness in any free motion element. Better methods of valve actuation are needed. My copending patent application for a Remote Controlled Selector Valve offers an improved combination.

OBJECTS

It is therefore an object of this invention to provide a perforated drill collar that is subject to being selectively actuated by cycling the drilling fluid flow rate from a first flow rate to a second flow rate, and back toward the first flow rate.

It is another object of this invention to provide apparatus that can divert drilling fluid flow from a drill bit to drill collar sidewall perforations by actions taken at the earth surface by manipulation of conventional drilling fluid flow controls.

It is yet another object of this invention to provide a perforated drill collar that can be assembled into the drill string without a complete remote control valve yet can be actuated by a recoverable object dropped down the drill string bore to force a flow diverter valve, a component of a remote control valve, to actuate the flow through the collar perforations.

These and other objects, advantages, and features of this invention will be apparent to those skilled in the art from a consideration of this specification, including the attached drawings and appended claims.

To accomplish the objectives herein defined, the remote control selector valve is shown in block form in the preferred assembly, so that the points of novelty of the present invention can more clearly be illustrated. By reference, the remote control selector valve of my copending application number 784,262 is made part of this invention.

It is to be understood that other downlink command actuators can be used to exercise the selector valve to select the option of directing drilling fluid to the drill bit or to the drill collar sidewall jets optionally. Typical downlink command actuators usable would include U.S. Pat No. 3,896,667 and U.S. Pat. No. 3,967,680. Such options are anticipated by and are within the scope of the claims.

BRIEF DESCRIPTION OF DRAWINGS

In the drawings, wherein like reference characters are used throughout to designate like parts.

DETAILED DESCRIPTION OF DRAWINGS

Some drawing details that may be of manufacturing or maintenance utility but do not contribute to description of points of novelty are omittd for clarity. Fluid tight seals that can be accomplished by abutting surfaces or moving seals that can be effectively accomplished by close clearances may not be shown with the convenient elastomeric inserts. Detail simplification steps are not to be regarded as a limiting feature.

Figure 1:
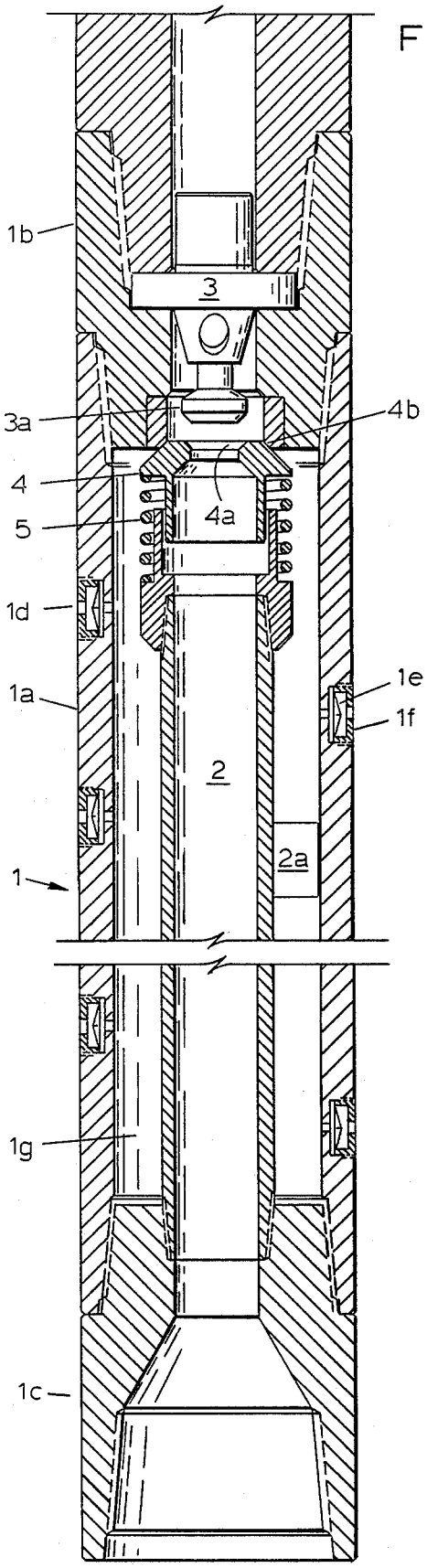
FIG. 1 is a side view, partially cutaway, of the preferred embodiment of the apparatus of this invention.

In FIG. 1, the collar 1 may actually be a series of collars connected into a drill string.

The upwardly continuing drill string is threadedly connected to the top of collar 1, and the downwardly continuing drill string (not shown) is threadedly connected to the bottom of collar 1. Collar 1 includes tube 1*a*, upper terminal 1*b*, and lower terminal 1*c*. Tube 1*a* has holes 1*d* extending radially through the wall. Inserts l*e* are shown to protect the holes from debris, but they are optional. When used, the inserts are retained by cover 1*f*.

A washpipe 2 is continuous and about concentric in the collar bore as stabilized by occasional centralizer fins 2*a*. The washpipe is threadedly connected at the lower end for fluid tightness and at the upper end is in fluid tight connection to diverter valve 4. Annulus lg is spaced between tube 1*a* and washpipe 2.

In the situation shown, fluid pumped downhole through the pipe string will continue through the washpipe on to and through the bottom hole assembly below, which may be only a drilling head or bit, but is generally regarded as a downwardly continuing drill string. Seal 4*b* prevents fluid flow to annulus 1*y*.

By the processes yet to be described, selector valve 3 can respond to surface communication actions to allow selector valve poppet 3*a* to move downward while drilling fluid is flowing downwardly in the drill string bore. When the poppet seats on diverter valve orifice 4*a*, the diverter valve will move downward, overcoming spring 5. This closes the washpipe bore and diverts downwardly moving drilling fluid into the annulus 1*b* formed between the washpipe and the collar bore. The drilling fluid, under pressure, will be ejected through holes 1*d* toward the borehole wall. When the channel is open to the annulus, a small amount of fluid may be allowed to flow through the washpipe to keep the drill bit from plugging. A small jet may be used in the poppet, or elsewhere, to permit this flow.

The distribution of perforations, or jets, through the collar sidewall will depend upon the nature of the formation being drilled. Additionally, stabilizer blades are often needed in the collar series, and these can be put on the regular collar or on short collar lengths. Such short devices are called "stabilizers," and they may or may not have sidewall perforations.

Figure 2:
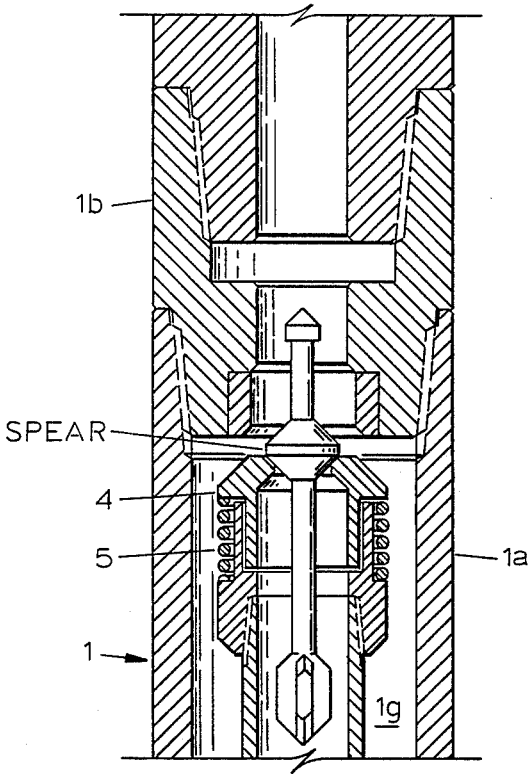
FIG. 2 is a side view, in cutaway, of an alternate actuating system for the apparatus of this invention.
Figure 3A:
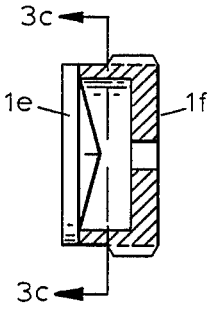
FIGS. 3 (*a, b, c,* and *d*) are partial cutaway views of one detail feature of the apparatus of this invention.
Figure 3B:
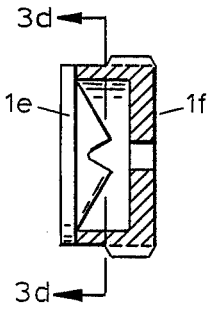
Figure 3C:
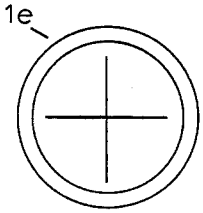
Figure 3D:
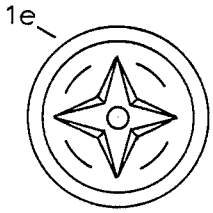

FIG. 2 shows the apparatus of FIG. 1 with the selector valve actuator left out and a recoverable spear used to actuate the diverter valve which is, in this assembly, an intrinsic part of the selector valve. Here the diverter valve seal 4*b* is shown open. The spear can be recovered by use of an overshot grabber on a wire line run down the drill string bore.

FIGS. 3 (*a, b, c,* and *d*) shows a rubber insert 1*e* used in the collar sidewall perforations to discourage the random entry of drilling debris and other particulates into the collar annulus through idle jets. In FIG. 3*a*, the side view of the jet shows the insert closed. FIG. 3*b* shows a side view of the insert open, and FIG. 3*c* is a view taken along line 3*c*–3*c* of FIG. 3*a* showing the insert idle. FIG. 3*d* taken along line 3*d*–3*d* shows the insert open. This is a special purpose check valve.

Selector valve 3 will now be described. This is the preferred embodiment of my copending application No. 784,262. This valve will respond to each resumption of drilling fluid flow by changing the position of poppet 3*a* of FIG. 1. The two possible positions (or states) are open or closed with reference to orifice 4*a*. The preferred design parameters of the remote control selector valve will cause a change of state when flow is stopped and restarted. If it is preferred to continue drilling, after stopping fluid flow, with the valve poppet in the same position it occupied when fluid flow was previously stopped, a short flow cycle is executed, then stoped and restarted.

Figure 4:
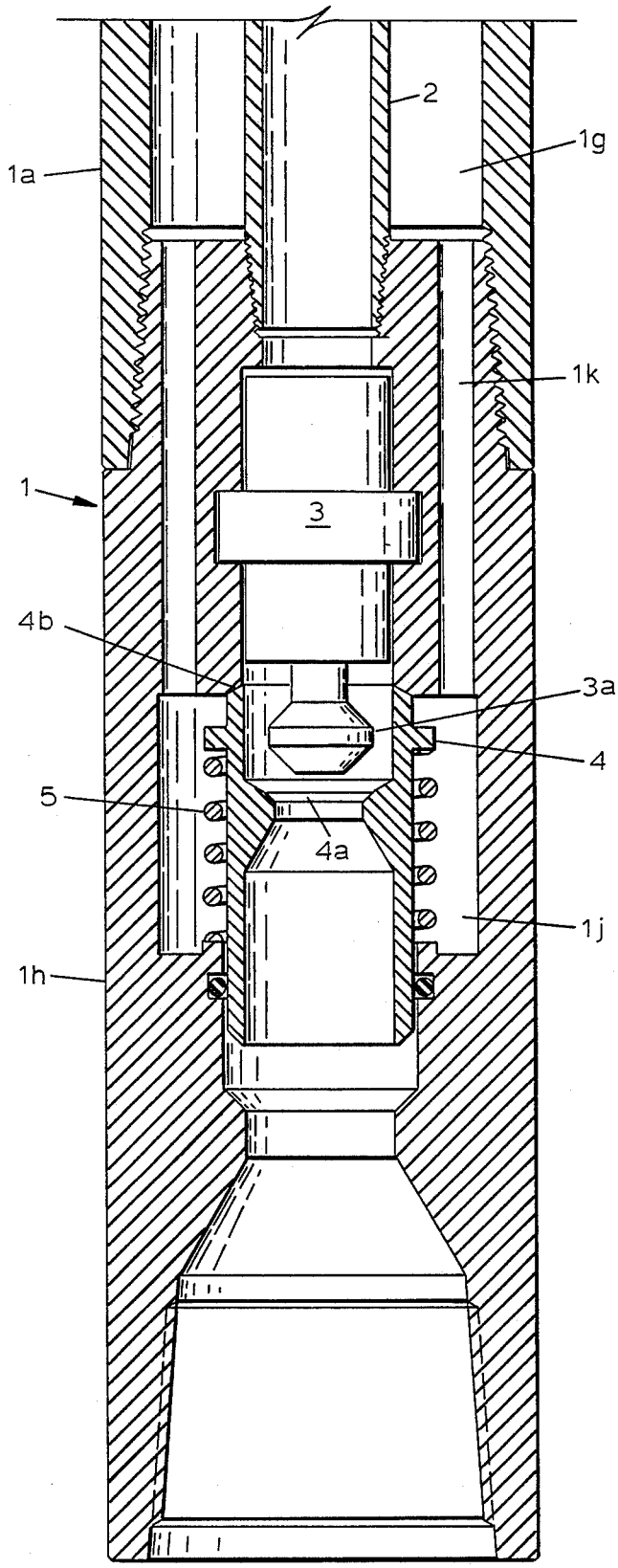
FIG. 4 is a side view, partially cutaway, of an alternate embodiment of apparatus of this invention.

FIG. 4 differs from FIG. 1 only in the location of the remote control selector valve and the routing of some fluid channels. Placing the selector valve at the lower end of the assembly is in deference to the occasional need to run instruments down the drill string bore to the vicinicy of the drill head.

Washpipe 2 will be made fluid tight at the connections to collar 1 at both ends by any convenient means. The lower terminal 1*h* has provisions for removably mounting the selector valve actuator 3 and the diverter valve 4, which is part of the remote control selector valve assembly, but such assembly utility features are not shown for greater clarity of points of novelty.

The function of the selector valve has been described, but the fluid flow is, here, always through the washpipe 2. Fluid from orifice 4*a*, when open, goes directly to the downwardly continuing drill string. The channel made available to the drilling fluid, when poppet 3*a* closes orifice 4*a* and pushed down the diverter valve, elemenmt 4 is through the then opened seal 4*b*, into cavity 1*j*, and up through holes 1*k*, into the annulus 1*g*, and finally through holes 1*d*.

The spear shown in FIG. 2 can be used with the imbodiment of FIG. 4, if the remote control actuator 3 is left out temporarily and the diverter valve element 4, which is commonly part of the remote control selector valve assembly, is left in the downhole assembly.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, I claim:

1. In a well drilling system having a string of drill pipe suspended in a well bore and means, at the earth surface, to force and control the flow of drilling fluid downwardly through the drill string bore, apparatus comprising:

(a) A body to perform as a drill string interval, with an upper and a lower end, comprising; an outer tube with end terminals, each having means to attach with fluid tight engagement to the continuing drill string, an inner tube generally coaxial, for some length, with said outer tube, and an annular space between said coaxial tube walls;

(b) means, situated in said body, responsive to fluid flow controlled signals, generated at the earth surface, to produce a first output signal in response to said signals of a first characteristic and responsive to said signals of a second characteristic to produce a second output signal;

(c) fluid flow channel selector means, situated in said body, responsive to said first output signal to provide a fluid flow channel from the upwardly continuing drill string to the downwardly continuing drill string and responsive to said second output signal to provide a fluid flow channel for at least part of said fluid flow from the upwardly continuing drill string to said annular space;

(d) surfaces describing at least one hole through the wall of said outer tube.

2. The apparatus of claim 1 further providing a plurality of stabilizer fins extending generally from the outer wall of said inner tube to the vicinity of the inner wall of said outer tube.

3. The apparatus of claim 1 further providing at least one spiral stabilizer fin, the radial dimension of which extends from the vicinity of the outer wall of said inner tube to the vicinity of the inner wall of said outer tube.

4. The apparatus of claim 1 further providing that said surfaces defining said holes through the wall of said outer tube extend in a generally radial direction.

5. The apparatus of claim 1 further providing for fluid tight engagement of both ends of said inner tube to said outer tube with said second channel extending from said upper connection to said annular space to include said inner tube bore.

6. The apparatus of claim 1 further providing for said second channel to include the bore of said inner tube, said fluid flow being directed, at least in part, from the lower end of said inner tube to said annular space.

7. The apparatus of claim 1 further providing means responsive to said second output signal to at least partly close said first fluid flow channel.

8. Apparatus of claim 1 further providing that said means responsive to fluid flow controlled signals, generated at the earth surface, comprise a separable assembly including a remote control selector valve actuator means to selectively produce said first and said second output signals, and a separable fluid flow diverter valve means responsive to said output signals to execute said channel selection options.

9. The apparatus of claim 8 further providing surfaces describing said fluid flow diverter valve means, in the absence of said remote control selector valve actuator means, to respond to the presence of an object arriving downhole from the earth surface, through the pipe string bore, to select one of said channel options, the other of said channel options being selected in the absence of said object.

10. In a well drilling related system involving a pipe string suspended in an earth borehole with means at the earth surface to force and control the flow of drilling fluid downhole through the pipe bore, apparatus comprising:

(a) A body defining a length of drill string with an upper and lower end and means at each end to attach in fluid tight engagement to the continuing drill string;

(b) a body midsection comprising an inner tube and an outer tube generally coaxial with an elongated annular space therebetween;

(c) a first fluid conducting channel, in said body, capable of conducting fluid from said upper end connection, through the bore of said inner tube to said lower end connection;

(d) a second fluid conducting channel, in said body, capable of conducting at least part of said fluid flow from said upper end connection to said annular space;

(e) a remote control selector valve actuator means, situated in said body, responsive to fluid flow controlled signals generated at the earth surface, to respond to signals of a first characteristic to produce a first output signal and responsive to signals of a second characteristic to produce a second output signal;

(f) fluid flow channel selector means, situated in said body, responsive to said first output signal to direct the fluid flow to said first channel, and responsive to said second output signal to direct at least part of said fluid flow to said second channel;

(g) surfaces describing at least one hole through the wall of said outer tube.

11. The apparatus of claim 10 further comprising, for said remote control fluid flow selector valve means, at least one flow directing element responsive to the arrival downhole of an object inserted into the drill string bore at the earth surface to execute the selection of one of said channels, and responsive to the absence of said object at said downhole location to select the other of said channel options.

12. The apparatus of claim 10 further providing that said channel selector means be so constructed that, in the absence of said remote control selector valve actuator means, it will respond to an object in contact with said selector means to select one of said channel options, said object movable through the drill string from the earth surface, the other of said channel options being selected in the absence, downhole, of said object.

13. The apparatus of claim 10 further providing that said length of pipe string comprise a plurality of lengths connected in series in fluid tight engagement, said annular space further provided with fluid communication channels to form a common fluid body when fluid filled.

14. The apparatus of claim 10 further providing at least one stabilizer means extending from the vicinity of the outer wall of said inner tube to the vicinity of the inner wall of said outer tube.

15. The apparatus of claim 10 further providing means to resist the movement of materials inwardly through said holes in said outer tube wall.

16. The apparatus of claim 15 further providing that said means to resist movement of said materials inwardly through said holes comprises an elastomer element that will open a passage therethrough when deformed by pressure inside said outer tube tending to urge materials outwardly through said holes.

17. The apparatus of claim 10 further providing that said fluid flow channel selector means comprise a generally tubular valve element situated to telescope with said inner tube between a first extended position relative to said inner tube and a second more shortened position relative to said inner tube, sealing means on said tubular valve element to engage said body in fluid tight engagement when in said first position to close said second channel.

18. The apparatus of claim 17 further providing that said remote control selector valve actuator comprise a poppet movable between a first and a second position representative of change from one of said output signals to the other, further providing that said channel selector means have a cooperating orifice situated to at least resist the flow of fluid to said first channel when said poppet is in said first position and to permit flow to said second channel when said poppet is in said second position, further providing that said channel selector means telescoping element move under the force of downwardly moving drilling fluid to said second telescoped position when said orifice and poppet cooperate to resist fluid flow to open said sealing means to provide said second channel, further providing bias means to urge said telescoping means to close said second channel.

19. The apparatus of claim 10 further providing that said remote control selector valve actuator and said fluid flow channel selector means be located below said inner tube.

* * * * *